United States Patent [19]

Flowers

[11] 4,332,203

[45] Jun. 1, 1982

[54] RAILWAY CAR FLOOR ASSEMBLY APPARATUS

[76] Inventor: Robert Flowers, 519 N. Dawson St., Thomasville, Ga. 37192

[21] Appl. No.: 54,801

[22] Filed: Jul. 5, 1979

Related U.S. Application Data

[63] Continuation-in-part of Ser. No. 861,715, Dec. 19, 1977, abandoned.

[51] Int. Cl.[3] ..... B23Q 13/00; B25C 7/00; B61D 17/10; B66F 13/00

[52] U.S. Cl. ..... 105/422; 29/252; 74/570; 145/1 B; 227/121; 227/127; 227/147; 254/11; 269/134

[58] Field of Search ..... 29/252; 52/227, 593, 52/749, 763; 74/107, 570, 571; 105/422; 145/1 B; 173/31, 39, 139; 227/99, 121, 147, 151, 152, 121, 147, 127; 254/11, 35, 93 R; 269/134

[56] References Cited

U.S. PATENT DOCUMENTS

| | | | |
|---|---|---|---|
| 292,446 | 1/1884 | Sims | 74/570 X |
| 806,138 | 12/1905 | Haskitt | 74/570 X |
| 873,637 | 12/1907 | Topham | 173/39 X |
| 1,323,688 | 12/1919 | Graham et al. | 254/93 R |
| 1,577,491 | 3/1926 | Prentice | 254/11 |
| 1,807,715 | 6/1931 | Tucker | 105/422 |
| 1,851,931 | 3/1932 | Chapman | 227/147 X |
| 2,169,433 | 8/1939 | Roy | 227/147 X |
| 2,511,843 | 6/1950 | Graether | 269/134 X |
| 2,710,166 | 6/1955 | Miller | 254/11 |
| 2,774,969 | 12/1956 | Samples | 227/147 |
| 3,012,247 | 12/1961 | Sillars et al. | 227/121 |
| 3,112,488 | 12/1963 | Dettloff et al. | 227/127 |
| 3,143,335 | 8/1964 | Lassahn | 254/11 |
| 3,528,376 | 9/1970 | Curtis, Jr. | 105/422 |
| 3,939,546 | 2/1976 | Hernandes | 254/11 |
| 4,099,707 | 7/1978 | Anderson | 254/35 |

*Primary Examiner*—Joseph F. Peters, Jr.
*Assistant Examiner*—Howard Beltran
*Attorney, Agent, or Firm*—Walker & McKenzie

[57] ABSTRACT

A device for forcing railroad car deck planks downward against a support and sidewards against a stop to aid in tying the plank to the support with a clip-like tie member. The device includes an anchor member for being fixedly attached to the support, a body member attached to and extending upward from the anchor member, an engagement member for engaging a portion of the plank, and a jack member for selectively causing the engagement member to force the plank downwards and sidewards relative to the body member.

22 Claims, 11 Drawing Figures

IX
2.72
2.19
2.87
2.79"
2.11
2.79
2.17
2.99
2.69
2.99
2.79'
2.73
2.15
2.67
2.67
2.75
2.77
2.63
2.13
2.67
2.67
IX
2.65

RAILWAY CAR FLOOR ASSEMBLY APPARATUS

CROSS-REFERENCE TO RELATED APPLICATION

This is a continuation-in-part of my application, Ser. No. 861,715, filed Dec. 19, 1977, now abandoned entitled "Ram Means."

BACKGROUND OF THE INVENTION

1. Field of the invention

The present invention relates generally to ram-type means for use in laying floors consisting of a plurality of abutting planks resting on support members and more specifically to such ram-type means especially adapted for use in laying floors in railroad cars.

2. Description of the Prior Art

The following patents disclosed ram means for urging adjacent planks or the like against one another during the laying of a floor: Prentice, U.S. Pat. No. 1,577,491; Tucker, U.S. Pat. No. 1,807,715; Miller, U.S. Pat. No. 2,710,166; Lassahn, U.S. Pat. No. 3,143,335; and Hernandez, U.S. Pat. No. 3,939,546. None of the above patents disclose or suggest the present invention.

Prior ram-type means for use in laying floors consisting of a plurality of abutting planks resting on support members have been disadvantageous for a number of reasons. For example, no prior ram-type means applied force downward on the planks thereby making it difficult to tie such planks to support members with clip-like tie means such as disclosed in Curtis, U.S. Pat. No. 3,528,376. Also, all known prior ram-type units require some disadvantageous procedure of anchoring the unit to allow the unit to direct a force against the planks being laid. At present, the normal method used to attach such planks to support members with a clip-like tie means is to utilize a prize bar with a foot to rest on the floor panel and an extension on the end to hook under the flanges of the support member. This is used to exert vertical pressure and a sledge hammer with a wood block cushion is used to move the plank horizontally into place.

SUMMARY OF THE INVENTION

The present invention is directed towards overcoming the problems and disadvantages of prior ram means for use in laying floors in railroad cars. The concept of the present invention is to provide a ram means which will force a plank downwards and sidewards so that such a plank can be easily and quickly tied to a support member with a clip-type tie means such as disclosed in U.S. Pat. No. 3,528,376.

The ram means of the present invention includes, in general, an anchor means for being selectively anchored to a support means of a railroad car adjacent a railroad car deck plank that is to be tied to the support means; a body means attached to and extending upwardly from anchor means; an engagement means for engaging a portion of the plank; and a jack means for selectively causing the engagement means to force the plank downwards and sidewards relative to the body means. The jack means may include a first member attached to the body means and a second member attached to the engagement means. The first and second members of the jack means are movably attached to one another. Also, the jack means may include a control means for allowing the second member of the jack means to be selectively moved away from the first member thereof in a downward and sideward direction relative to the body means thereby selectively causing a downwards and sidewards force to be applied to the plank.

DESCRIPTION OF THE PREFERRED EMBODIMENTS

Figure 1:
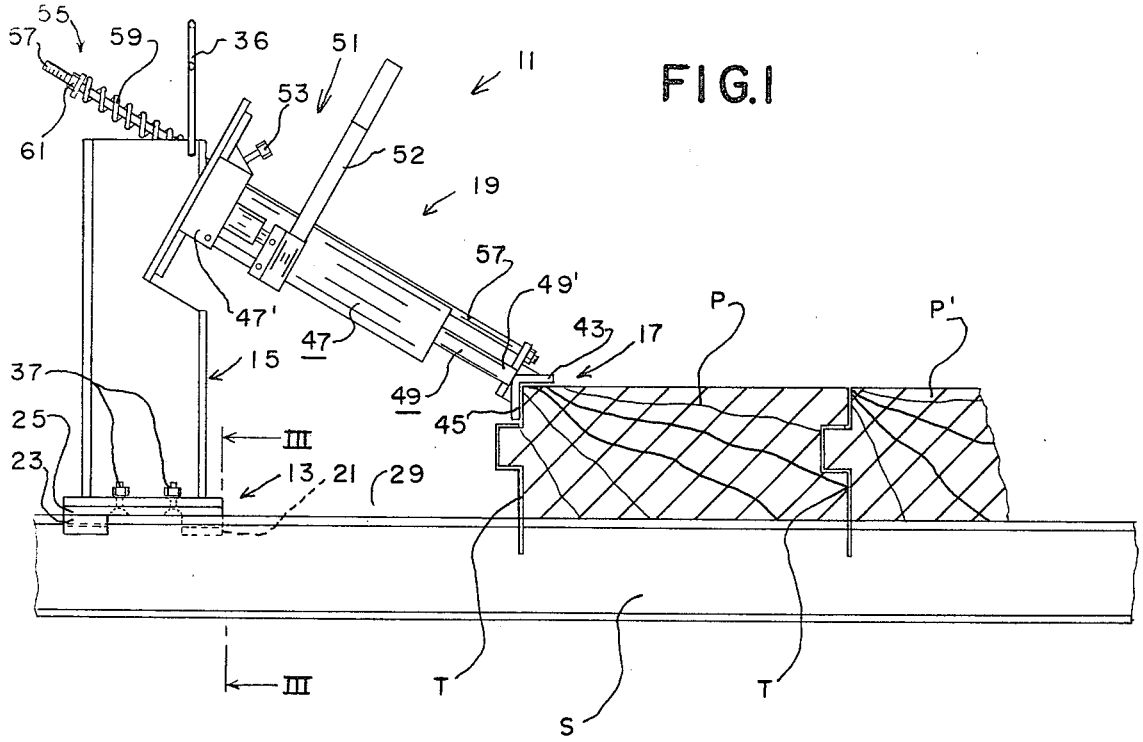
FIG. 1 is a side elevational view of a first embodiment of the ram means of the present invention shown forcing a railroad car deck plank downwards against a support member and sidewards against a stop member.

The ram means of the present invention is for use in laying deck planks P in a railroad car so as to floor the railroad car. The ram means is especially for such use when tongue and groove type deck planks P are to be tied to the support means or stringers S of the railroad car by way of clip-type tie means T as disclosed by U.S. Pat. No. 3,528,376. Attaching the deck planks P to the stringers S by way of such clip-type tie means T has proved to be highly advantageous for the reasons given in U.S. Pat. No. 3,528,376. The ram means of the present invention is used to force such a plank P downwards against one or more stringers S and sidewards against a stop means such as an adjacent, abutting plank P' which has been previously tied or otherwise fixedly attached to the stringers S.

A first embodiment of the ram means of the present invention is shown in FIGS. 1–6 and identified by the numeral 11. In general, the ram means 11 includes an anchor means 13 for being selectively anchored to a stringer S adjacent a plank P, a body means 15 attached to and extending upwardly from the anchor means 13, an engagement means 17 for engaging a portion of the plank P, and a jack means 19 for selectively causing the engagement means 17 to force the plank P downwards and sidewards relative to the body means 15.

Figure 2:
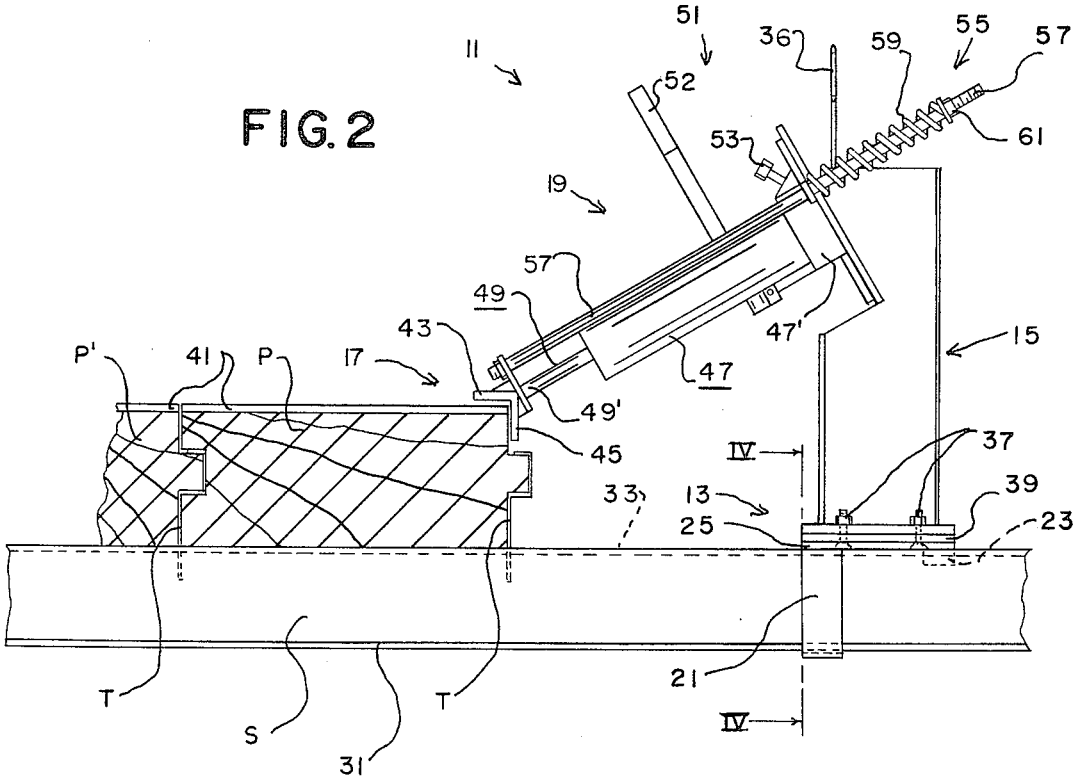
FIG. 2 is a side elevational view of the first embodiment ram means of the present invention substantially similar to FIG. 1 but showing the opposite side of the ram means and showing a modified railroad car deck plank and support means.
Figure 3:
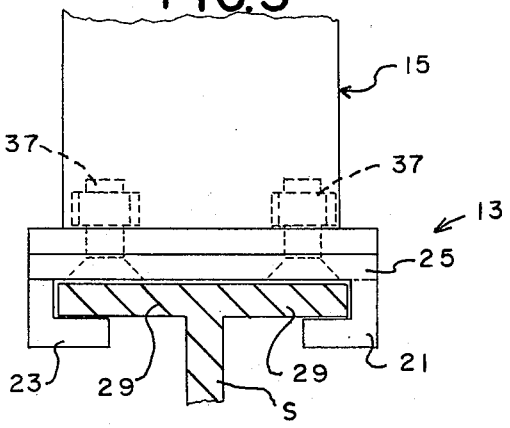
FIG. 3 is a sectional view as taken on line III—III of FIG. 1.
Figure 4:
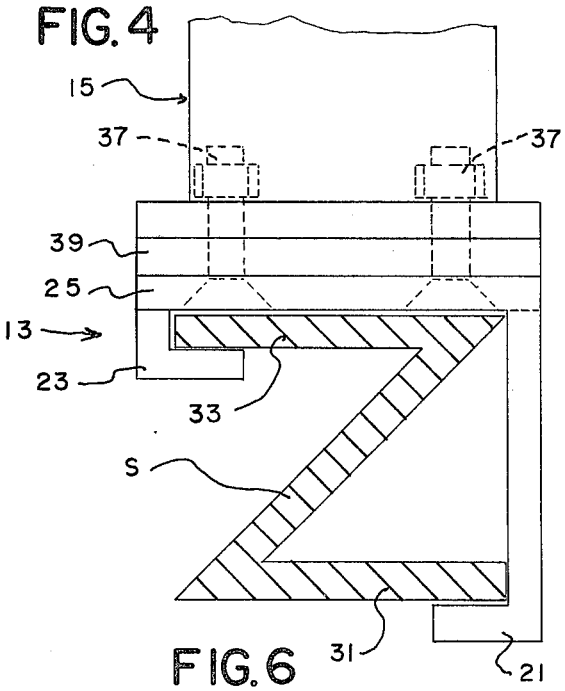
FIG. 4 is a sectional view as taken on line IV—IV of FIG. 2.
Figure 5:
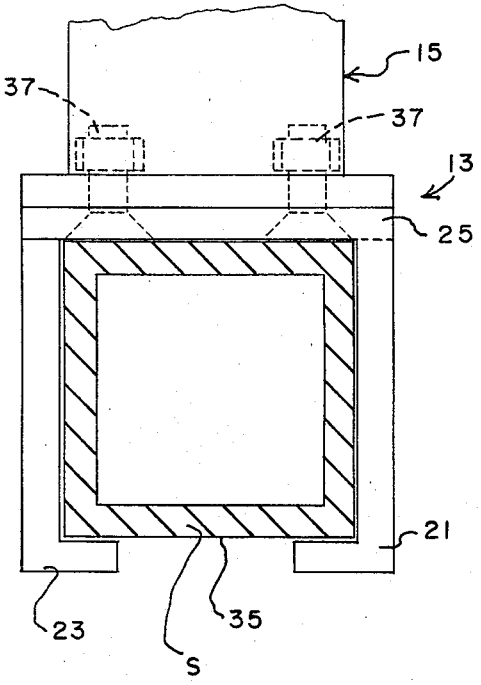
FIG. 5 is a sectional view as similar to FIGS. 3 and 4 but showing the ram means attached to a modified support means.

The anchor means 13 includes first and second hook means 21, 23 for engaging opposite edges of the stringer S. Preferably, the anchor means 13 includes a plate member 25 for resting upon the stringer S. The first and second hook means 21, 23 are mounted on the plate member 25 and depend downwardly therefrom as clearly shown in the drawings for attaching the plate member 25 to the stringer S. The plate member 25 may be substantially rectangular in shape (FIG. 6) and the first and second hook members 21, 23 are preferably located substantially at diagonally opposite corners of the plate member 25. More specifically, the first and second hook members 21, 23 are preferably diagonally spaced apart an amount sufficient to allow the anchor means 13 to be placed over the stringer S with the first and second hook means 21, 23 positioned on opposite sides of the stringer S (FIG. 5). To attach the anchor means 13 to the stringer S, the plate means 25 is merely rotated in the direction indicated by the arrows 27 in FIG. 6 to cause the first and second hook means 21, 23 to engage the stringer and thereby attach the plate member 25 thereto. The stringer S may consist of an I-beam as shown in FIGS. 1 and 3, in which case the first and second hook members 21, 23 preferably engage opposite edges of the top flange 29 of the I-beam as clearly shown in FIGS. 1 and 3. On the other hand, the stringer S may consist of a well-known Z-bar as shown in FIGS. 2 and 4 and in which case the first hook member 21 engages the open edge of the lower flange 31 of the Z-bar and the second hook member 23 engages the opened edge of the upper flange 33 of the Z-bar as clearly shown in FIGS. 2 and 4. Further, the stringer S may be substantially rectangular in cross section as shown in FIG. 5 in which case the first and second hook members 21, 23 preferably engage opposite edges of the bottom 35 of the stringer S as clearly shown in FIG. 5. The hook means 21, 23 may thus be adapted to attach the anchor means 13 to different shapes of stringers S.

The body means 15 is attached to and extends upwardly from the anchor means 13. More specifically, the body means 15 is attached to the plate member 25 of the anchor means 13. The body means 15 may include an upwardly extending handle member 36 for allowing the ram means 11 to be easily moved. The anchor means 13 and body means 15 may be constructed as an integral, one-piece unit. However, the anchor means 13 is preferably removably attached to the body means 15 by bolt assemblies 37 or the like. This allows a single ram means 11 to be utilized with different shape stringers S by merely attaching an anchor means 13 specifically adapted to be attached to the specific shape stringer S as heretofore discussed.

Additionally, by removably attaching the anchor means 13 to the body means 15, a spacer 39 may be utilized between the anchor means 13 and body means 15 (FIGS. 2 and 4) to allow the ram means 11 to be utilized with planks P of varying thicknesses. More specifically, FIG. 2 shows the ram means 11 being utilized with the plank P having an overlay 41 or the like attached thereto causing the thickness of the plank to be greater than the thickness of the plank in FIG. 1 and, thereby, causing the ram means 11 to require the use of a spacer 39 to properly position the engagement means 17 on the plank P as should now be apparent to those skilled in the art.

The engagement means 17 is for engaging a portion of the plank P (FIGS. 1 and 2). The engagement means 17 preferably includes a first portion 45 for contacting a portion of the top of the plank P and preferably includes a second portion 45 for contacting a portion of the side of the plank P as clearly shown in FIGS. 1 and 2. The first and second portions 43, 45 of the engagement means 17 are preferably positioned substantially at right angles to one another (FIGS. 1 and 2).

The jack means 19 is for selectively causing the engagement means 17 to force the plank P downwards and sidewards relative to the body means 15. The jack means 19 includes a first member 47 attached to the body means 15 and a second member 49 attached to the engagement means 17. The first and second members 47, 49 of the jack means 19 are movably attached to one another. The jack means 19 additionally includes a control means 51 for allowing the second member 49 to be moved away from the first member 47 in a downward and sideward direction relative to the body means 15 thereby selectively causing a downwards and sidewards force to be applied to the plank P. The jack means 19 may consist of any various types of jack means such as a hydraulic jack, pneumatic jack, a screw jack, or a ratchet type jack. Preferably, the jack means 19 consists of a self-contained hydraulic jack means of any construction and operation well known to those skilled in the art. The first member 47 preferably consists of a piston housing and base fixedly attached to the body means 15 on a downwardly sloping angle as clearly shown in FIGS. 1 and 2. The second member 49 preferably consists of a piston rod slidably received in the piston housing. The control means 51 preferably consists of a hand-operated pump communicated with the piston housing in a well-known manner so as to selectively cause the piston rod to move outward from the piston housing. The control means 51 preferably includes a handle member 52 for allowing pressure to be manually built-up in the piston housing and preferably includes a manually operable valve member 53 for allowing the built-up pressure within the piston housing to be released thereby removing the force from the plank. Such a jack means is well known to those skilled in the art and is presently used in various manners to jack up portions of automobiles or the like. The jack means 19 may include a spring means 55 for normally maintaining the second member 49 thereof in an unextended position relative to the first member 47 thereof. The spring means 55 may include a rod 57 fixedly attached to the distal end 49' of the second member 49 adjacent the engagement means 17 and extending back along the second member 49 through the base portion 47' of the first member 47. A spring 59 is positioned on the rod 47 between a stop member 61 such as a nut or the like on the end of the rod 57 and the base portion 47' of the first member 47 in such a manner so as to normally urge the rod 57 rearwardly thereby normally maintaining the second member 49 is an unextended position relative to the first member 47 as will now be apparent to those skilled in the art.

Figure 6:
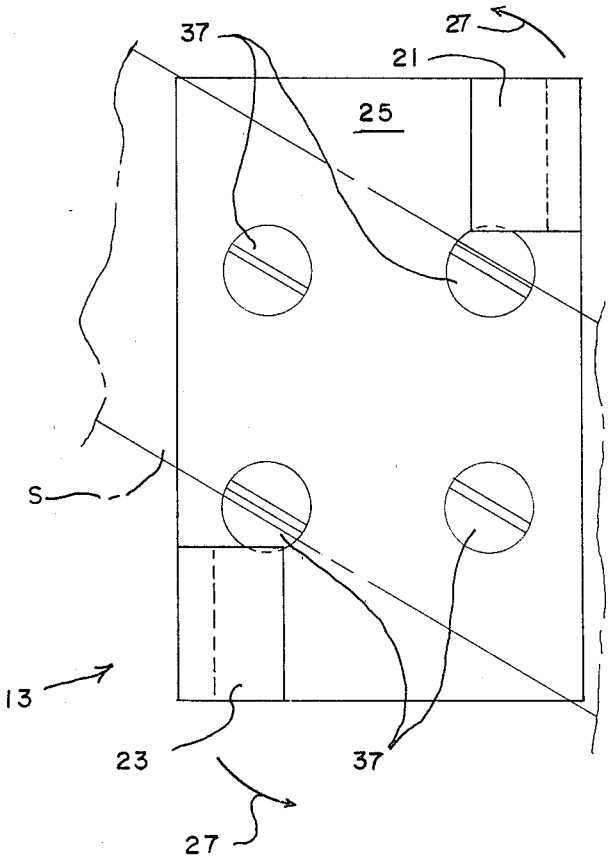
FIG. 6 is a bottom plan view of the anchor means shown in FIGS. 1 and 3.
Figure 7:
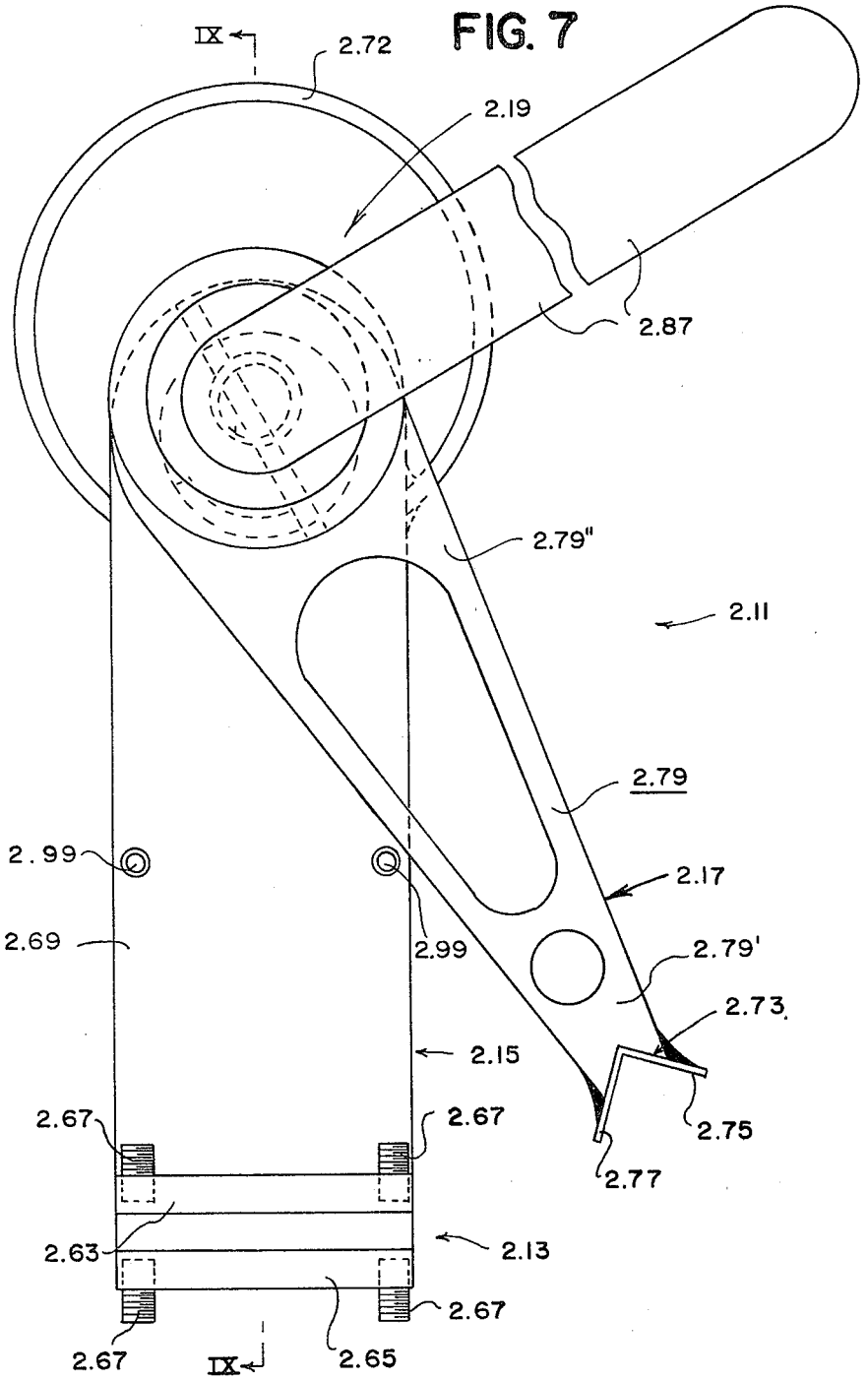
FIG. 7 is a front elevational view of a second embodiment of the ram means of the present invention.
Figure 8:
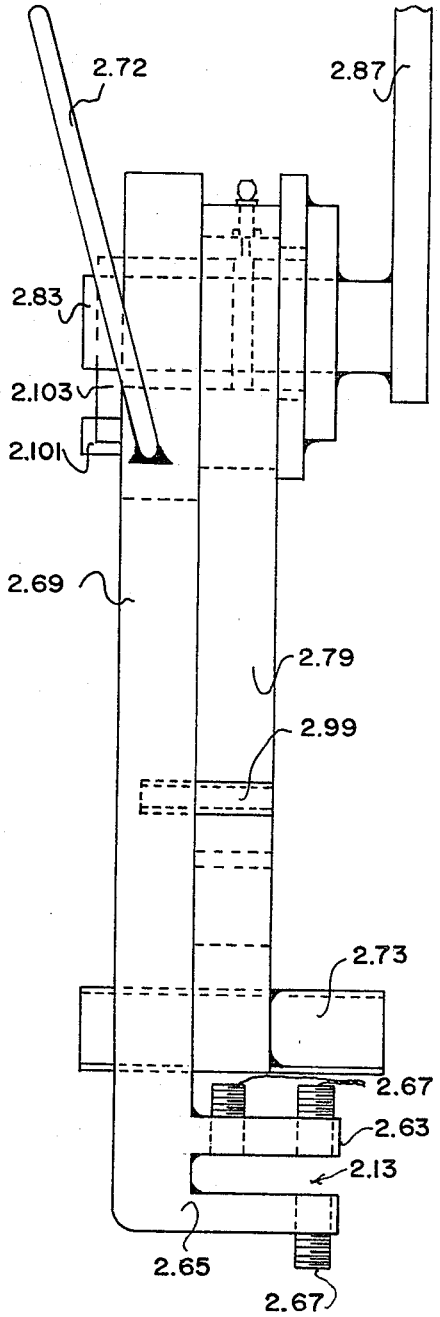
FIG. 8 is a side elevational view thereof.
Figure 9:
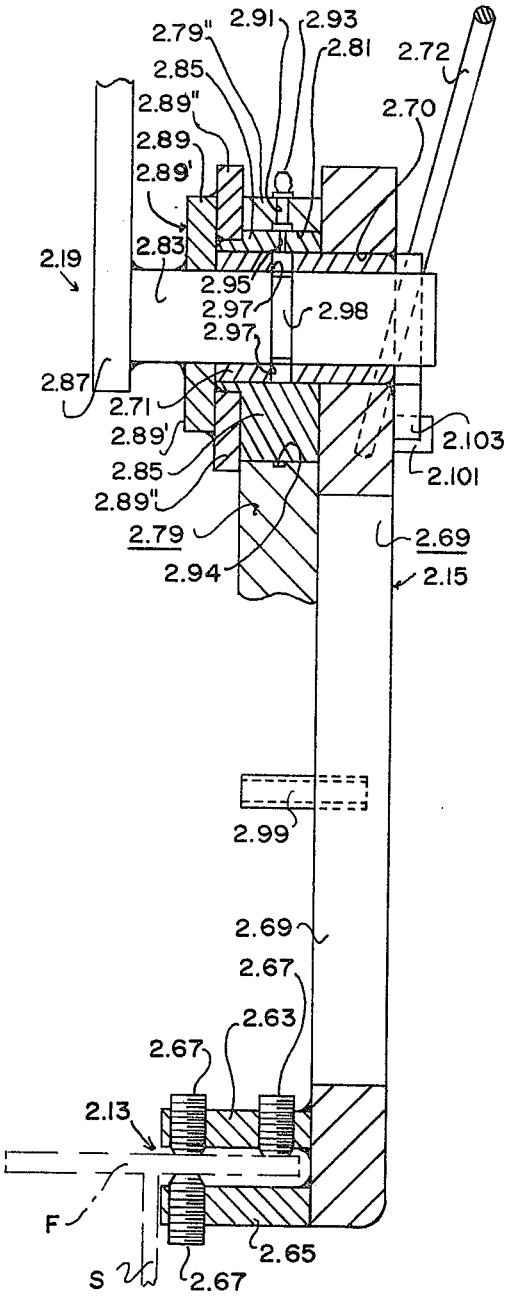
FIG. 9 is a sectional view thereof as taken on line IX—IX of FIG. 7 with some portions removed and/or shown in moved positions for clarity and with a support member shown in broken lines.

The operation of the ram means 11 is quite simple. First, the anchor means 13 is placed over a stringer S and the plate member 23 thereof rotated as indicated in FIG. 6 so as to cause the first and second hook means 21, 23 to engage a portion of the stringer S. The ram means 11 is then slid along the stringer S until the engagement means 17 properly contacts the plank P to be tied to the stringer. The control means 51 is then activated to cause the second member 49 of the jack means 19 to extend relative to the first member 47 thereof thereby causing a downwards and sidewards force to be applied to the plank P. This also serves to tip the anchor means 13 rearwardly a small amount thereby causing the first and second hook means 21, 23 to lockably engage portions of the stringer S and thereby lockably attaching the ram means 11 to the stringer S. The tie means T can then be easily applied in the manner well known to those skilled in the art. Next, the valve member 53 is opened to release the jack means 19 allowing the ram means 11 to be moved away from the plank P and removed from the stringer S. It should be noted that more than one such ram means 11 may be used in tying one plank P to the stringers S. More specifically, two ram means 11, one on each end of the plank P, is preferably used.

A second embodiment of the ram means of the present invention is shown in FIGS. 7–11 and identified by the numeral 2.11. In general, the ram means 2.11 of the present invention includes an anchor means 2.13 for being selectively anchored to a stringer S adjacent a plank P, a body means 2.15 attached to and extending upwardly from the anchor means 2.13, and engagement means 2.17 for engaging a portion of the plank P, and a jack means 2.19 for selectively causing the engagement means 2.17 to force the plank P downwards and sidewards relative to the body means 2.15 (see, in general, FIGS. 10 and 11).

The anchor means 2.13 is for being selectively anchored to the stringer S adjacent the plank P to be tied thereto. The support means or stringer S preferably includes a flange portion F similar to the flange of a well known I-beam member (see FIG. 9). The anchor means 2.13 preferably includes a first plate member 2.63 for being positioned above the flange portion F of the stringer and preferably includes a second plate member 2.65 for being positioned below the flange portion F of the stringer S. The anchor means 2.13 preferably includes a plurality of screw means 2.67 screwably extending through the first and second plate members 2.63, 2.65 (see, in general, FIG. 9) for selectively engaging the flange portion F of the stringer S to fixedly attach the ram means 2.11 thereto.

The body means 2.15 is attached to and extends upwardly from the anchor means 2.13. More specifically, the body means 2.15 may consist of an elongated plate member 2.69 having the first and second plate members 2.63, 2.65 fixedly attached to the lower end thereof as clearly shown in FIG. 9. The body means 2.15 preferably has a transverse aperture 2.70 through the upper end of the plate member 2.69 and with an outwardly extending, annular flange member 2.71 thereabout for reasons which will hereinafter become apparent. The body means 2.15 may also include an upwardly extending hand grip member 2.72 attached to the upper end of the plate member 2.69 for allowing the ram means 2.11 to be easily held and/or moved. The first and second plate members 2.63, 2.65, plate member 2.69, flange member 2.71 and hand grip member 2.72 may be integrally constructed as one piece unit from a substantially rigid material such as steel or the like in any manner apparent to those skilled in the art such as by welding the various components to one another. The plate member 2.69 may be of a substantially open construction to reduce the weight of the ram means 2.11.

The engagement means 2.17 is for engaging a portion of the plank P. The engagement means 2.17 preferably includes a foot member 2.73 for directly engaging a portion of the plank P. The foot member 2.73 may include a first portion 2.75 for contacting a portion of the top of the plank P and may include a second portion 2.77 for contacting a portion of one side of the plank P (see FIG. 11). The first and second portions 2.75, 2.77 are preferably positioned substantially at right angles to one another. The engagement means 2.17 also preferably includes a leg member 2.79 having a first end 2.79' and a second end 2.79''. The first end 2.79' of the leg member 2.79 is attached to the foot portion 2.73 such as by welding or the like. The second end 2.79'' of the leg member 2.79 has a transverse aperture 2.81 therethrough for coacting with the jack means 2.19 in a manner which will hereinafter become apparent. The foot member 2.73 and leg member 2.79 may be integrally constructed as a one piece unit from any substantially rigid material such as steel. The leg member 2.79 may be of a substantially open construction to reduce the weight of the ram means 2.11.

The jack means 2.19 is for selectively causing the engagement means 2.17 to force the plank P downwards and sideswards relative to the body means 2.15. The jack means 2.19 preferably includes an axle means 2.83 rotatably attached to the plate member 2.69 of the body means 2.15. That is, the axle means 2.83 preferably extends through the flange member 2.71 and transverse aperture 2.70 in the upper end of the plate member 2.69 (see FIG. 9). The jack means 2.19 preferably includes an eccentric means 2.85 fixedly attached to the axle means 2.83 and rotatably extending through the transverse aperture 2.81 of the engagement means 2.17 for acting as a cam to cause the engagement means 2.17 to move in a downwards and sidewards direction relative to the body means 2.15 when the axle means 2.83 is rotated thereby selectively causing a downwards and sidewards force to be applied to the plank P. The jack means 2.19 may include a crank member 2.87 fixedly attached to the axle means 2.83 for use in rotating the axle means 2.83. The axle means 2.83 and the eccentric means 2.85 may be fixedly attached to one another by way of a flange means 2.89 having a first portion 2.89' fixedly attached to the axle means 2.83 and having a second portion 2.89'' fixedly attached to a portion of the eccentric means 2.85 (see FIG. 9). The axle means 2.83, eccentric means 2.85, crank means 2.87 and flange means 2.89 may be integrally constructed as a one piece unit from a substantially rigid material such as steel or the like in any manner apparent to those skilled in the art such as by welding the various components to one another.

The ram means 2.11 may be adapted to allow a lubricant such as grease to be inserted into the rotating portions thereof. For example, the leg member 2.79 may have a passageway including an aperture 2.91 to which a typical grease fitting 2.93 is attached and an annular groove 2.94 which joins the aperture 2.81. The eccentric 2.85 may have a passageway including an aperture 2.95 for allowing the lubricant to pass from the outer periphery thereof to the flange member 2.71. The flange member 2.71 may include a passageway including aperture 2.97 for allowing the lubricant to pass from the outer periphery thereof to an annular groove 2.98 in the axle means 2.83.

The ram means 2.11 may include a first stop means for limiting rotation of the leg member 2.79 with respect to the plate member 2.69 of the body means 2.15. This stop means may include a pair of peg members 2.99 attached to and extending outward of the plate member 2.69 of the body means 2.15 for selectively engaging the leg member 2.79 to limit rotation thereof with respect to the body means 2.15.

The ram means 2.11 may also include a second stop means to limit rotation of the axle means 2.83 with respect to the body means 2.15. This second stop means may include a lug 2.101 attached to and extending outwardly of the plate member 2.69 of the body means 2.15 and may include a pin 2.103 extending transversely through the axle means 2.83 for engaging the lug 2.101 to limit rotation of the axle means 2.83 with respect to the body means 2.15. It should be noted that the pin 2.103 may also serve to prevent accidental removal of the jack means 2.19 and the engagement means 2.17 from the body means 2.15.

Figure 10:
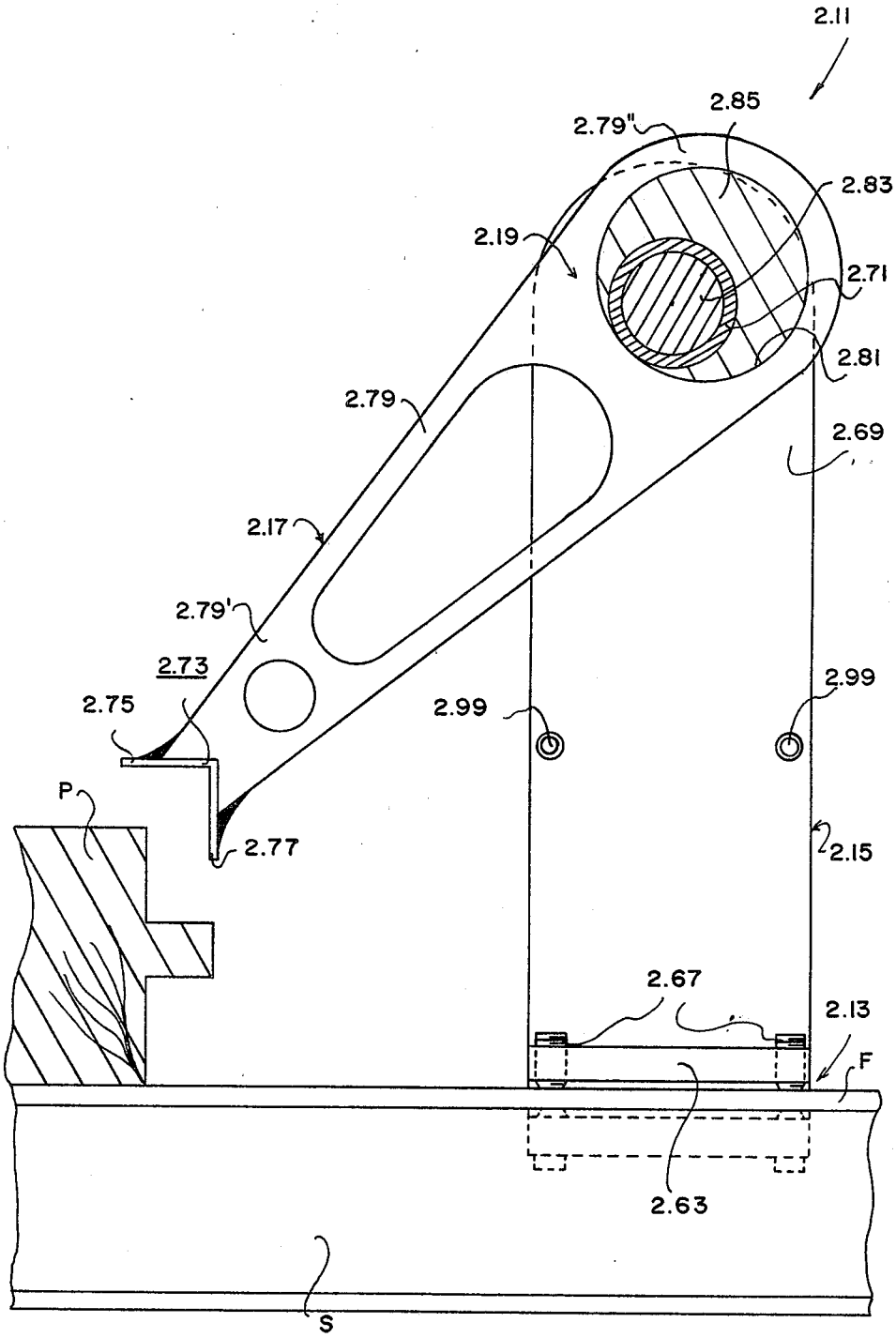
FIG. 10 is a somewhat diagrammatic front elevational view thereof with some portions thereof broken away, with the engagement means and jack means shown in a "retracted" position, and with a support member and a plank associated therewith.
Figure 11:
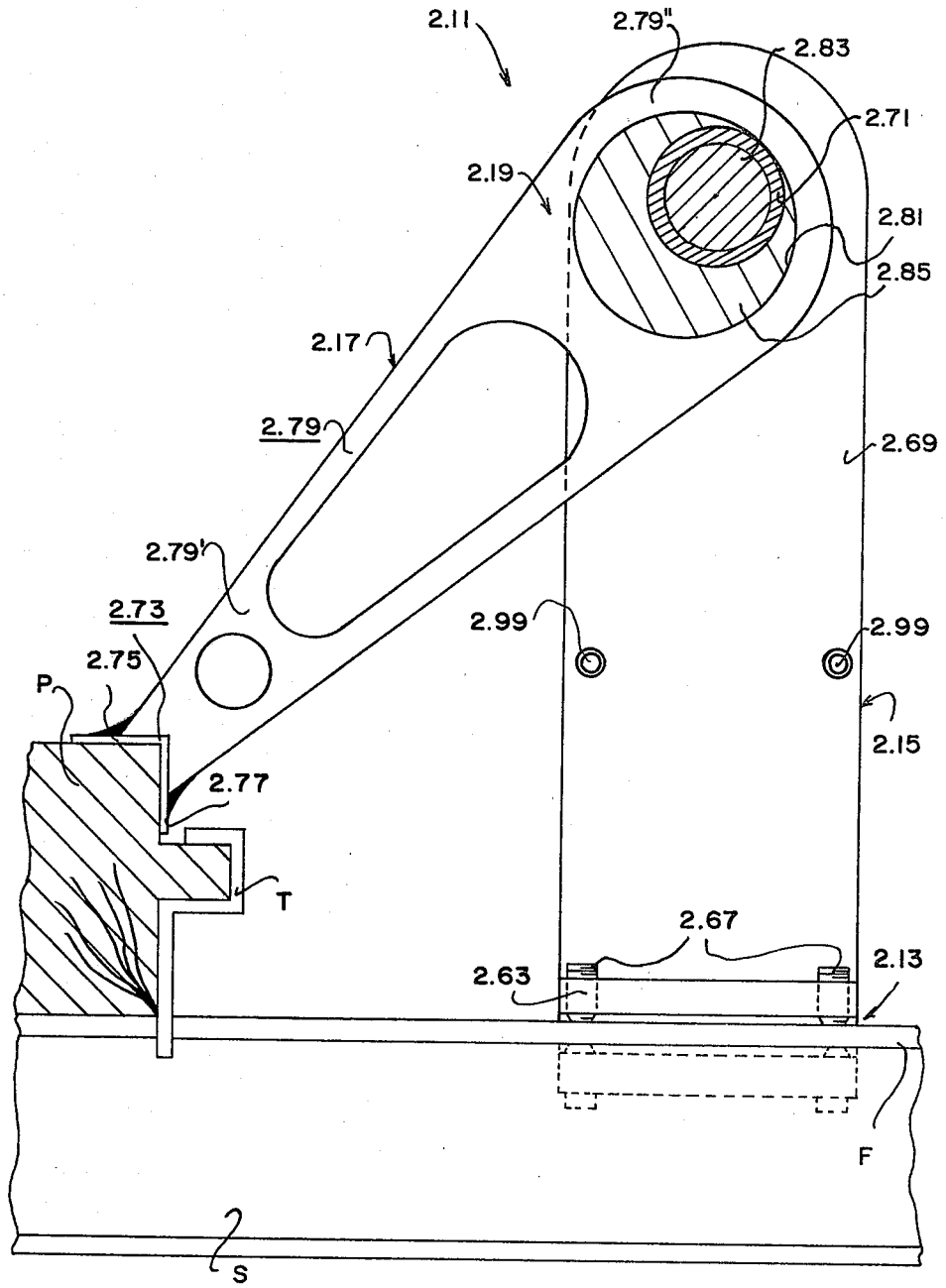
FIG. 11 is a view similar to FIG. 10 but with the engagement means and the jack means in an "extended" position and with a tie shown attaching the plank to the support member.

The operation of the ram means 2.11 is quite simple. First, with the engagement means 2.17 and the jack means 2.19 in a "retracted" position as shown in FIG. 10, the anchor means 2.13 is attached to a stringer S with the foot member 2.73 of the engagement means 2.17 properly positioned with respect to the plank P to be tied to the stringer S. The anchor means 2.13 is attached to the stringer S by merely inserting the first and second plate members 2.63, 2.65 about the flange portion F of the stringer and adjusting the screw means 2.67 to engage the flange portion F (see FIG. 9). Next, the crank member 2.87 is rotated to move the engagement means 2.17 and the jack means 2.19 to an "extended" position as shown in FIG. 11 thereby causing a downwards and sidewards force to be applied to the plank P. This also may cause the body means 2.15 to tip rearwardly a small amount which will cause the anchor means 2.13 to lock onto the flange portion F of the stringer S as will be apparent to those skilled in the art. A tie means T (see FIG. 11) can then be easily applied in a manner well known to those skilled in the art. Next, the crank member 2.87 is moved back to its original position causing the engagement means 2.17 and the jack means 2.19 to move to the "retracted" position as shown in FIG. 10 to allow the ram means 2.11 to be moved away from the plank P and removed from the stringer S. It should be noted that more than one such ram means 2.11 may be used in tying one plank P to the stringer S.

As thus constructed and used, the present invention provides a ram means for use in laying railroad car floors consisting of a plurality of abutting planks which will force a plank downward and sideward so that such a plank can be easily and quickly tied to a support with a clip-type tie means as disclosed in U.S. Pat. No. 3,528,376, which automatically locks itself in place when jack pressure is applied, which automatically releases itself for easy and quick removal when jack pressure is released, which can be quickly and easily anchored to and removed from a support means, which will hold a plank in place until the clip-like tie means are applied, which requires only moderate direct pressure to be exerted by the operator, and which is light-weight so as to permit ease of handling.

Although the invention has been described and illustrated with respect to preferred embodiments thereof, it is not to be so limited since changes and modifications may be made therein which are within the full intended scope of the invention.

I claim:

1. An apparatus for properly positioning a railroad car deck plank on a floor beam of a railroad car against a stop means prior to said deck plank being attached to said floor beam with clip-like tie means, said apparatus comprising, in combination:

(a) anchor means for being readily and removably applied to said floor beam adjacent said plank, said anchor means including hook means for positive engagement with a downwardly facing surface of said floor beam and for easily and removably mounting said anchor means on said floor beam;

(b) a post attached to and extending upward from said anchor means, said post having a first end for being attached to said anchor means and having a second end for being located above said floor beam when said anchor means is applied to said floor beam;

(c) engagement means for engaging a portion of said plank, said engagement means including a first portion for contacting the top of said plank and including a second portion for contacting the side of said plank, said first and second portions of said engagement means being positioned substantially at right angles to one another; and (d) jack means for selectively causing said engagement means to force said plank downwards against said floor beam and sidewards against said stop means, said jack means having a first end being attachable to said second end of said post for downward inclination and having a second end for being attached to said engagement means, said jack means inclining downwardly with respect to said floor beam to exert a downward and sideward force through said first and second members of said engagement means on said plank.

2. The ram apparatus of claim 1 in which said jack means includes a first member attached to said post and a second member attached to said engagement means, said first and second members of said jack means being movably coupled to one another, and in which said jack means includes a control means for allowing said second member of said jack means to be selectively moved away from said first member thereof in a downward and sideward direction relative to said post thereby selectively causing a downwards and sidewards force to be applied to said plank.

3. The apparatus of claim 2 in which said engagement means includes a first portion for contacting the top of said plank and includes a second portion for contacting the side of said plank, said first and second portions of said engagement means being positioned substantially at right angles to one another.

4. The apparatus of claim 2 in which said jack means is a self-contained hydraulic jack.

5. The apparatus of claim 2 in which said jack means includes a spring means for normally maintaining said second member thereof in a retracted position relative to said first member thereof.

6. The apparatus of claim 2 in which said anchor means includes a plate member for resting upon said floor beam and includes first and second hook members mounted on said plate member for attaching said plate member to said floor beam.

7. The apparatus of claim 6 in which said plate member is substantially rectangular in shape, in which said first and second hook members are located substantially at diagonally opposite corners of said plate members, and in which said first and second hook members are diagonally spaced apart an amount sufficient to allow said anchor means to be placed over said floor beam with said first and second hook means positioned on opposite sides of said floor beam and to allow said plate to be rotated so as to cause said first and second hook means to engage said floor beam and attach said plate member thereto.

8. The apparatus of claim 7 in which said floor beam is an I-beam and in which said first and second hook members engage opposite edges of the top flange of said I-beam.

9. The apparatus of claim 7 in which said floor beam is a Z-bar, in which said first hook member engages the opened edge of the lower flange of said Z-bar, and in which said second hook member engages the opened edge of the upper flange of said Z-bar.

10. The apparatus of claim 7 in which said floor beam is substantially rectangular in cross section and in which said first and second hook members engage opposite edges of the bottom of said floor beam.

11. The apparatus of claim 1 in which said jack means includes an axle means rotatably attached to said post and in which said jack means includes an eccentric means fixedly attached to said axle means and engaging said engagement means for causing said engagement means to move in a downward and sideward direction relative to said post when said axle means is rotated thereby selectively causing a downwards and sidewards force to be applied to said plank.

12. The apparatus of claim 11 in which said jack means includes a crank member fixedly attached to said axle means for use in rotating said axle means.

13. The apparatus of claim 12 in which said engagement means includes a foot member for directly engaging a portion of said plank and includes a leg member having a first end and a second end, said first end of said leg member being attached to said foot portion, said second end of said leg member having a transverse aperture therethrough for rotatably receiving said eccentric means of said jack means.

14. The apparatus of claim 13 in which said foot member of said engagement means includes a first portion for contacting a portion of the top of said plank and includes a second portion for contacting a portion of one side of said plank, said first and second portions of said foot member being positioned substantially at right angles to one another.

15. The apparatus of claim 13 in which said floor beam includes a flange portion, in which said anchor means includes a first plate member for being positioned above said flange portion of said support means and includes a second plate member for being positioned below said flange portion of said floor beam.

16. The apparatus of claim 15 in which said anchor means includes screw means extending through said first and second plate members for engaging said flange portions of said floor beam.

17. The apparatus of claim 13 in which said body means includes annular flange member for extending between said axle means of said jack means and a portion of said eccentric means of said jack means.

18. The apparatus of claim 17 in which said leg member of said engagement means has a passageway means for allowing the passage of a lubricant to and about said transverse aperture thereof, in which said eccentric means has a passageway means for allowing said lubricant to pass from said passageway means of said leg member to said annular flange member of said body means, and in which said annular flange member has a passageway means for allowing said lubricant to pass from said passageway means of said eccentric means to said axle means.

19. The apparatus of claim 17 in which is included stop means for limiting rotation of said leg member of said engagement means with respect to said body means.

20. The apparatus of claim 19 in which said stop means includes peg means attached to and extending outward of said a post for engaging said leg member of said engagement means to limit rotation thereof with respect of said post.

21. The apparatus of claim 19 in which is included a second stop means for limiting rotation of said axle means with respect to said post.

22. The apparatus of claim 21 in which said second stop means includes a lug attached to and extending outwardly of said body means and includes a pin extending transversely through said axle means for engaging said leg to limit rotation of said axle means with respect to said body means.

* * * * *